US010779628B2

(12) United States Patent
McMullen

(10) Patent No.: US 10,779,628 B2
(45) Date of Patent: Sep. 22, 2020

(54) ELECTRICAL AUTOMATED NAIL-CLIPPING DEVICE

(71) Applicant: Thomas J. McMullen, Bloomington, MN (US)

(72) Inventor: Thomas J. McMullen, Bloomington, MN (US)

( * ) Notice: Subject to any disclaimer, the term of this patent is extended or adjusted under 35 U.S.C. 154(b) by 275 days.

(21) Appl. No.: 15/715,886

(22) Filed: Sep. 26, 2017

(65) Prior Publication Data

US 2019/0090608 A1 Mar. 28, 2019

(51) Int. Cl.
*A45D 29/02* (2006.01)
*A45D 29/05* (2006.01)

(52) U.S. Cl.
CPC ..... *A45D 29/023* (2013.01); *A45D 29/05* (2013.01); *A45D 2029/026* (2013.01)

(58) Field of Classification Search
CPC . A45D 29/023; A45D 29/02; A45D 2029/026
See application file for complete search history.

(56) References Cited

U.S. PATENT DOCUMENTS 5,557,849 A * 9/1996 Lee ..... A45D 29/02 132/75.4
5,622,191 A * 4/1997 McMullen, Jr. ..... A45D 29/02 132/73
5,791,049 A * 8/1998 Dolev ..... A45D 29/02 132/75.5
7,003,882 B2 * 2/2006 Sakai ..... A45D 29/02 30/26
7,954,242 B1 * 6/2011 Brizan ..... A45D 29/02 30/28
2007/0028936 A1 * 2/2007 Kriser ..... A45D 29/023 132/76.4
2009/0119922 A1 * 5/2009 Doyle ..... A45D 29/02 30/28
2010/0107989 A1 * 5/2010 Manheimer, III ..... A01K 13/00 119/600

* cited by examiner

*Primary Examiner* — Cris L. Rodriguez
*Assistant Examiner* — Brianne E Kalach
(74) *Attorney, Agent, or Firm* — Mark A. Litman & Associates, P.A.

(57) ABSTRACT

An electrically-powered nail cutting apparatus includes a housing having a front face and a rear face, two sides, a top and a bottom. The front face of the housing having an open slot at least 0.5 mm in height and between 0.7 cm and 4 cm in width, the slot having a front-facing opening and a rear-facing opening. Within the housing and proximal to the rear-facing opening is a vertically translating nail-cutting blade plate associated with an electric motor that is configured to translate the nail-cutting blade plate consecutively down and up. The blade plate is a solid material having an opening therein, wherein the top of the opening comprises a cutting blade with a cutting edge within the opening such that the cutting edge is adjacent the rear-facing element.

20 Claims, 8 Drawing Sheets

ELECTRICAL AUTOMATED NAIL-CLIPPING DEVICE

BACKGROUND OF THE INVENTION

1. Field of the Invention

The present invention relates to the field of toe nail clippers and especially automated toe nail clippers for use with human hands and feet for clipping fingernails and toenails.

2. Background of the Art

One of the more obvious needs for personal grooming is the need to clip to fingernails as they are unsightly when not properly addressed. Where open-toe shoes are used or individuals are barefoot, toenails are similarly important for grooming. Many groups of individuals are unable to groom their own nails because of infirmity, disability and the like, such as having only a single arm, back problems limiting bending, muscle weakness, partial paralysis, tremors, poor vision and the like. Nail trimming therefore becomes difficult and often requires individuals to seek the aid of others to enable them to maintain their desired level of personal grooming. This increases their dependency on others and adds to feelings of guilt in those requiring such basic care from third parties.

U.S. Pat. No. 7,954,2423 (Brizan) discloses a manual or electric nail clipper that can assist individuals to either manually or automatically clip a toenail or fingernail. The fingernail or toenail is inserted into the front end of the device and a pair of trimming edges move together to clip the fingernail or toenail safely, easily and conveniently. One of the embodiments contemplates a manual device and the other is an electric device.

U.S. Pat. No. 6,865,312 discloses a nail trimmer for enabling a person to comfortably trim toenails without having to take on an awkward or uncomfortable posture. The nail trimmer has a long extension housing, which has a handle at its upper end and a trimmer unit at its lower end. A battery operated motor and on/off switch are incorporated into the handle end. A detachable trimmer unit is connected at the lower end. A dado cutting blade and a gear unit are enclosed in the trimmer unit. An opening in the trimmer unit housing provides access to the cutting edge of the blade.

U.S. Pat. No. 5,123,430 (Davidovitz) discloses a cutter device particularly useful to for cutting fingernails and toenails includes a housing grippable by a user for holding and manipulating the device. A slot is formed in a conical end portion of the housing and is elongated in the circumferential direction for receiving a nail to be cut. A rotatable head having an outer conical surface is rotatably mounted within the conical end portion of the housing. A blade is fixed to the rotatable head and has a cutting edge extending substantially radially of the conical surface of the head and perpendicularly to the slot. A motor within the housing and coupled to the head rotates the head, and the blade fixed thereto, such that the cutting edge of the blade is rotated substantially perpendicularly to the direction of elongation of the slot and the nail received therein.

Various animal nail clippers have been shown in the prior art such as U.S. Pat. No. 2,955,354, issued to Laing, and U.S. Pat. No. 3,838,507 issued to Clark, and U.S. Pat. No. 4,228,585, issued to Nelson. One of the deficiencies in prior art clippers is no provision for localizing the quick of the nail prior to clipping the nail thus avoiding the aforementioned injury. The present invention overcomes this deficiency by providing a mechanically actuated nail clipper for an animal, or pet, which allows the user to sense the position of the quick prior to clipping the nail then to clip the nail safely at the desired length.

Further, the U.S. Pat. No. 3,845,553 to Fields showed a claw clipper with a reciprocating cutter. The clipper has a gauge 56 to establish how much nail to remove. The reciprocating cutter, 30, then is rapidly advance to clip the nail using a motorized screw. The cutter includes a spring to return the cutter to a recoiled position for the motorized screw to advance the cutter again, reciprocally. Alas, this patent does not detect the presence of the quick with any sensor.

The published patent application to Kang, No. 2006/0042559 shows a clipper for to pet claws with a lever operated cutter. The clipper receives a nail on the side and the nail proceeds between the two blades of the cutter. The cutter has a fixed blade and a rotating blade. Grasping the lever rotates the rotating blade to clip the nail. The application discloses a battery powered motor in the larger handle for grinding a clipped nail. The present invention though has a cutter that receives a nail from the bottom and a cutter with two blades. The blades of the present invention slide along a common line while abutting each other. The present invention lacks a motor or other grinding feature but does have the sensing means and quick indicator which differentiates the present invention from the Kang publication.

The U.S. Pat. No. 7,000,321 to Rodgers discloses an optical source and corresponding sensor for detecting the quick of an animal's nail. This patented device has a mechanical clipper with a sliding blade coupled with an optical source and sensor. The source and sensor are mounted proximate the clipper so an accurate reading of light passing through a nail is ascertained by the sensor prior to usage of the clipper. The present invention though has sensing through electrical charge or capacitance or resistance, a thermocouple, piezo-electric, heat, ultrasound, x-ray radiation, and infrared radiation. Once the quick is detected using the sensor, the present invention activates a quick indicator, preferably LED of single or multiple colors, to avoid startling an animal, to guide the user in operating the present invention.

The allowed patent application to Huggans, published as No. 2005/0132975, shows a hand powered nail and claw clipper. The clipper has a mechanical two blade guillotine type cutter where one blade is advanced along the other blade when the handle is closed. The clipper also has a sensor located in the fixed blade opposite the advancing other blade. The sensor is preferably a high intensity light with a cooperating detector or alternatively an ultrasound detector, a pulse oximeter, a laser, and an infra red thermometer. The present invention shares some features with this allowed application. However, the present invention has at least one LED to inform the operator visually, using single or multiple colors, about proximity to the quick and a detector capable of initializing itself. The detector establishes, or is uses a pre-established, baseline on a non-quick substance, such as air, and uses that baseline to later determine the location of the cutting blade relative to the quick. An operator need not look at the position of the cutting blade on a nail but rather at the LED.

U.S. Pat. No. 8,100,088 (Manheimer) discloses a clipper for clipping nails of an animal such as a dog, or cat, that allows for the clipping of an individual nail at the desired length while preventing injury to the animal, including a clipper portion and a sensing portion which allows the nail to be localized in a desired position relative to the clipping plane of the clipper and the internal structure of the nail, wherein the sensing portion is included within circuitry that includes a signal generation portion, a signal reception portion, and a quick indicator. The animal nail is positioned near the clipper portion and the sensing portion produces a sensible signal confirming the position of the clipping plane upon the nail, particularly the quick of the nail. The user then may adjust the position of the clipper portion such that the clipping plane avoids the quick. The user then actuates the clipper portion and trims the nail. (1. A device for safely cutting a nail of an animal to a desired length, while reducing the possibility of injury to said animal by cutting into a quick of the nail, comprising: at least one cutting blade; a means for mounting said cutting blade, said mounting means having an accommodation for a sensing means; mechanical actuating means for reciprocally moving said cutting blade from a first position to a second cutting position; a fixed blade having to an aperture for receiving the nail of the animal, said fixed blade being placed adjacent said cutting blade; said mounting means having a hollow handle, said handle accommodating said cutting blade, said fixed blade and said actuating means; said actuating means linking to said cutting blade, and having a moveable handle pivotally connecting with said hollow handle thus allowing a user to close is said moveable handle upon said hollow handle thus advancing said cutting blade upon said fixed blade to cut a nail of an animal placed within said aperture; a sensing portion capable of detecting the internal structure of the nail of the animal received in said aperture of said fixed blade and providing an indication thereof before actuation of said cutting blade, said sensing portion including said sensing means, an electrical supply located within said hollow handle, a digital processor, and a quick indicator connected together in circuitry; said sensing means arranged adjacent to and connecting with the fixed blade and comprising a capacitor, said capacitor having at least a single plate, said capacitor of the sensing means being arranged at the approximate front end of the sensing means and just adjacent to the edge of the aperture of the fixed blade, said electrical supply providing power to said plate, said capacitor being in communication through said circuitry with said quick indicator, said capacitor including a circuit portion of said circuitry such that changes in the instantaneous capacitance of the capacitor causes a change in the oscillatory frequency of said circuit portion, said oscillatory frequency being interpreted by said digital processor, the digital processor being programmed to differentiate between frequency arising from the interposing of air, nail, or nail with underlying quick as located near the fixed blade aperture during usage; and said quick indicator comprising a visual display communicating with the circuitry for warning a user of said device to the presence of quick of the nail of an animal therein during usage, said visual display being at least one light emitting diode, for warning the user of said device to the presence of quick of the nail of the animal to before any cutting occurs.)

U.S. Pat. No. 8,496,013 (McCourtney) discloses a fingernail clipper holding device includes a housing having a hollow interior and having a generally ellipsoid ergonomic configuration that is easy to grip. An upper portion of the housing may include a channel having a configuration to receive the housing of a fingernail clipping device and to hold it securely. The housing defines a receiving area on which a user may position his finger adjacent the cutting head of the fingernail clipping device. A gripping member is attached to a lower portion of the housing to receive a user's fingers or hand. Stabilizing members may be attached to the bottom surface of the lower portion to hold the housing stationary on a flat surface.

Other general disclosures of nail clipping systems include U.S. Pat. Nos. 6,539,632; 5,775,340; and 5,775,340 (with receptacle for cut nails). All documents cited herein are incorporated by reference in their entirety.

The prior art devices are often lacking in ease of use, require manual input, and do not consistently provide safety features to avoid injury to the users.

SUMMARY OF THE INVENTION

An electrically-powered nail cutting apparatus includes a housing having a front face and a rear face, two sides, a top and a bottom. The front face of the housing having an open slot at least 0.5 mm in height and between 0.7 cm and 4 cm in width, the slot having a front-facing opening and a rear-facing opening. Within the housing and proximal to the rear-facing opening is a vertically translating nail-cutting blade plate associated with an electric motor that is configured to translate the nail-cutting blade plate consecutively down and up. The blade plate is a solid material having an opening therein, wherein the top of the opening comprises a to cutting blade with a cutting edge within the opening such that the cutting edge is adjacent the rear-facing element.

DETAILED DESCRIPTION OF THE INVENTION

Figure 1:
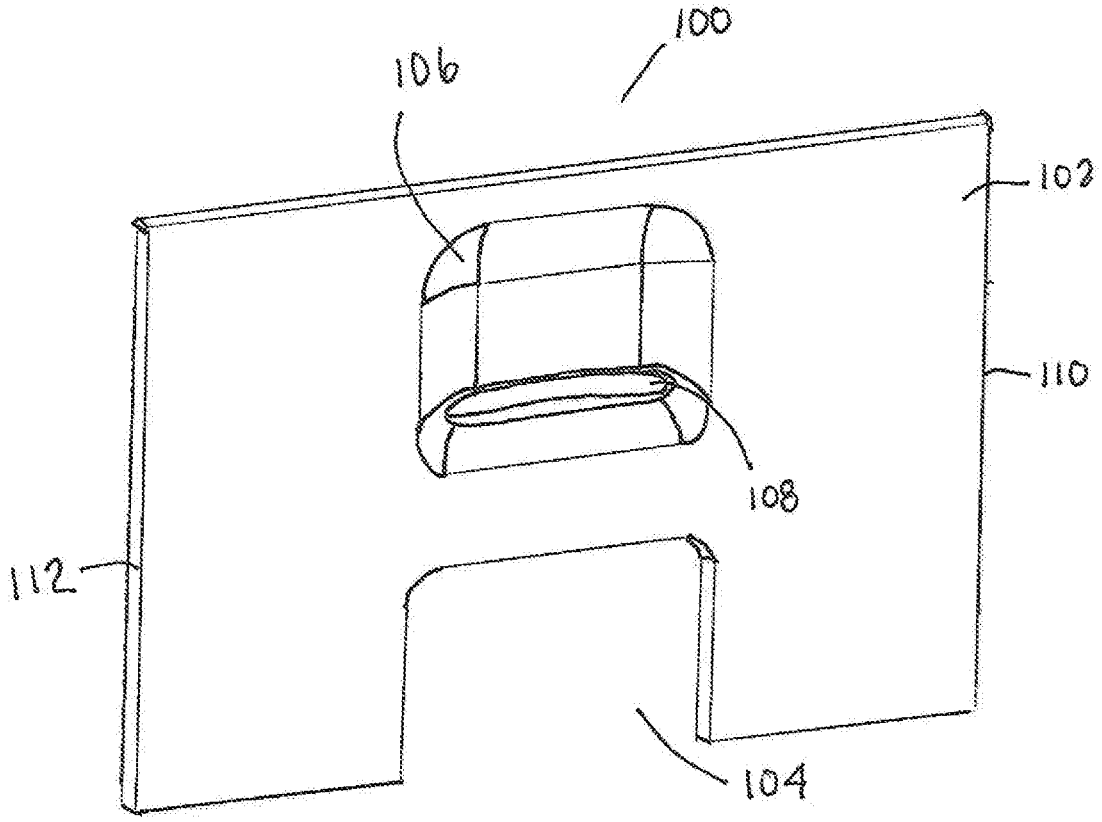
FIG. 1 is a perspective view of a front access plate on an electrically-powered nail cutting apparatus according to the present invention.

An electrically-powered nail cutting apparatus includes a housing having a front is face and a rear face, two sides, a top and a bottom. The front face of the housing having an open slot at least 0.5 mm in height and between 0.7 cm and 4 cm in width, the slot having a front-facing opening and a rear-facing opening. Within the housing and proximal to the rear-facing opening is a vertically translating nail-cutting blade plate associated with an electric motor that is configured to translate the nail-cutting blade plate consecutively down and up. The blade plate is a solid material having an opening therein, wherein the top of the opening includes a cutting blade with a cutting edge within the opening such that the cutting edge is adjacent the rear-facing element. The dimensions in height facilitate nail thickness entry into the cutting position. Some nails are more curved that others and thicker than others, so that these dimensions may significantly vary upwards, but will not vary to lesser heights as it would severely limit the number of people that could use the clipper. Upper heights can be 0.75 mm, 1.0 mm, 1.25 mm, 1.5 mm and even as much as 3.5 mm to allow toe nails that have been damaged and malformed to fit within the opening and be exposed to the blades. The opening may be relatively uniform in thickness, or have a greater height on one side (or in the middle) than on the other side (or sides) to allow easier unassisted entry into the opening at one position and then repositioning of the nail within the opening to align the entire nail within the opening. The blade used is preferably made of metal, a rust-resistant metal such as stainless steel or titanium, and other components may be to variously made of polymeric materials and metal (the motor must have some metal components).

The front-facing opening in the slot further preferably includes a recess for accepting tips of digits or toes when fingernails or toenails, respectively, are inserted into the slot, but without allowing any significant penetration of the flesh of the digit or toe into the opening where the blade could contact the flesh in a cutting orientation. This may be a three-dimensional depression, a cavity, a molded open area, or cutout volume in the front face of the housing.

The apparatus preferably has the electric motor configured to continually move the blade plate up and down, or the electric motor is configured to move the blade plate up and down, with a time delay in transition from at least one direction to the other. A timing element, rheostat or any other timing device may be used to allow time between downward movements of the blade plate for the user to exchange or reorient toes or fingers that are to have their nails trimmed without having to gauge when it is timely to insert a nail in the slot. An indicator light may also be present on the apparatus indicating an appropriate time period when a nail may be inserted as opposed to the user guessing when the slot may not be blocked by the blade plate in an extended, lowered position.

The apparatus may perform its up-and-sown movement of the blade plate by the electric motor engaging the blade plate with a rotating cam that engages the blade plate to repetitively move the blade plate up and down. The cam may have a post which impacts against the bottom of the blade plate or engages a slot in the blade plate (preferably relatively below the opening to the blade, so that the blade plate is pulled down and pushed up by the rotating movement of the post extending from the cam, driven by the motor).

The apparatus preferably has the blade plate supported within a groove located behind the front face of the housing, with the cutting edge proximal to the slot. The cutting edge of the blade plate should intimately slide across the slot during its repetitive movement. In the apparatus, a bracing plate may be located against a side of the blade plate distal from the cutting edge. The bracing plate stabilizes the blade plate as the blade plate moves up and down. The bracing plate can be inserted or removed from the apparatus by sliding the brace plate within a second groove that secures the blade plate within the apparatus. Upon removal of the bracing plate from the apparatus, the blade plate becomes exposed and can be removed from the apparatus. The blade plate is free sliding, and can be slid upward out of the apparatus (e.g., for replacement or sharpening) or it may be manually or tool-removed from the groove.

The apparatus may be configured wherein the bracing plate has raised or extending elements on a surface to transmit pressure against the blade plate. As the bracing plate is fixed within the apparatus, these elements press against the blade plate to assure a strong pressure of the blade against the slot.

A review of the figures will assist in an understanding of the present invention.

FIG. 1 is a perspective view of a front access plate 100 on an electrically-powered nail cutting apparatus according to the present invention. The front access plate 100 has a forward-facing surface 102, a right side 110, a left side 112, an opening 104 for insertion of a removable clippings collection tray (not shown), a recessed area 106 for positioning nails into a blade accessing nail receiving slot 108. The plate 100 may be permanently affixed onto an electrically-powered nail cutting apparatus according to the present invention, or may be slideable into place on the front of the electrically-powered nail cutting apparatus.

Figure 2:
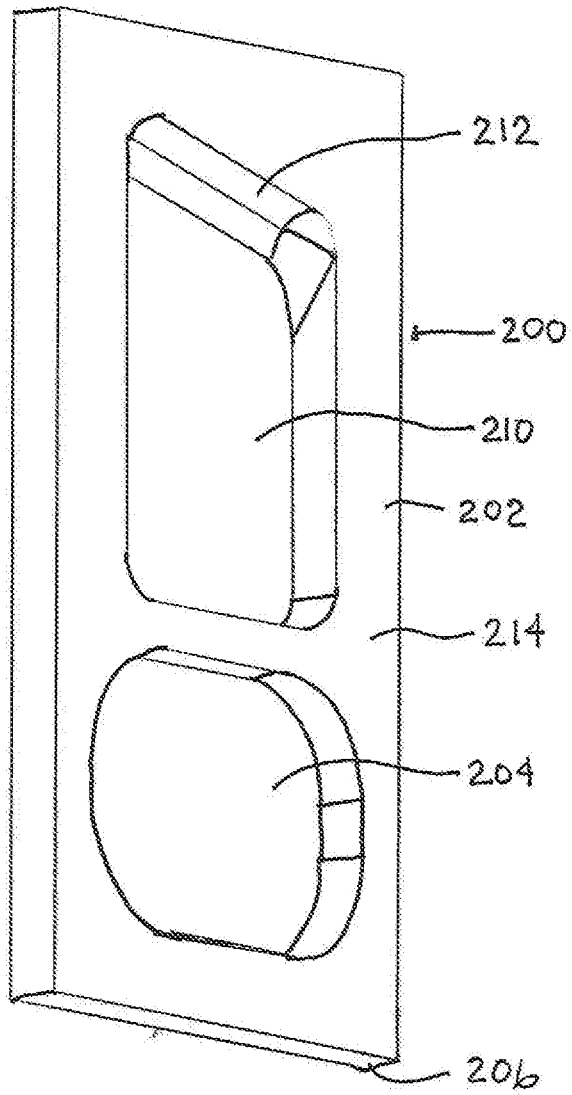
FIG. 2 is a perspective view of a reciprocating cutting blade in an electrically-powered nail cutting apparatus according to the present invention.

FIG. 2 is a perspective view of a reciprocating cutting blade unit 200 in an electrically-powered nail cutting apparatus according to the present invention. The blade unit 200 has a structural frame 202, a blade providing opening 210, a cam attending opening 204 to assist in movement of the blade unit 200, a bottom surface 205 of the blade unit 200, and a blade 212 which is moved repeatedly up and down to slice nails inserted into the electrically-powered nail cutting apparatus according to the present invention. The blade 212 is shown here in a distal portion of the blade unit 200, but may be on a more proximal position in the blade unit 200. That is, the cutting edge of the blade 212 may be farther from or closer to surface 214 of the blade unit 200. As later explained, a rotating element with an eccentrically positioned cam post has the post positioned within the cam attending opening 204. As the cam post is eccentrically driven, it forces the blade unit 200 up and down to drive the blade 212. The cam attending opening 204 would likely (as later shown) be wider (parallel to the bottom 206 of the blade unit 200 than represented in FIG. 2.

Figures 3A, 3B, 3C, 3D:
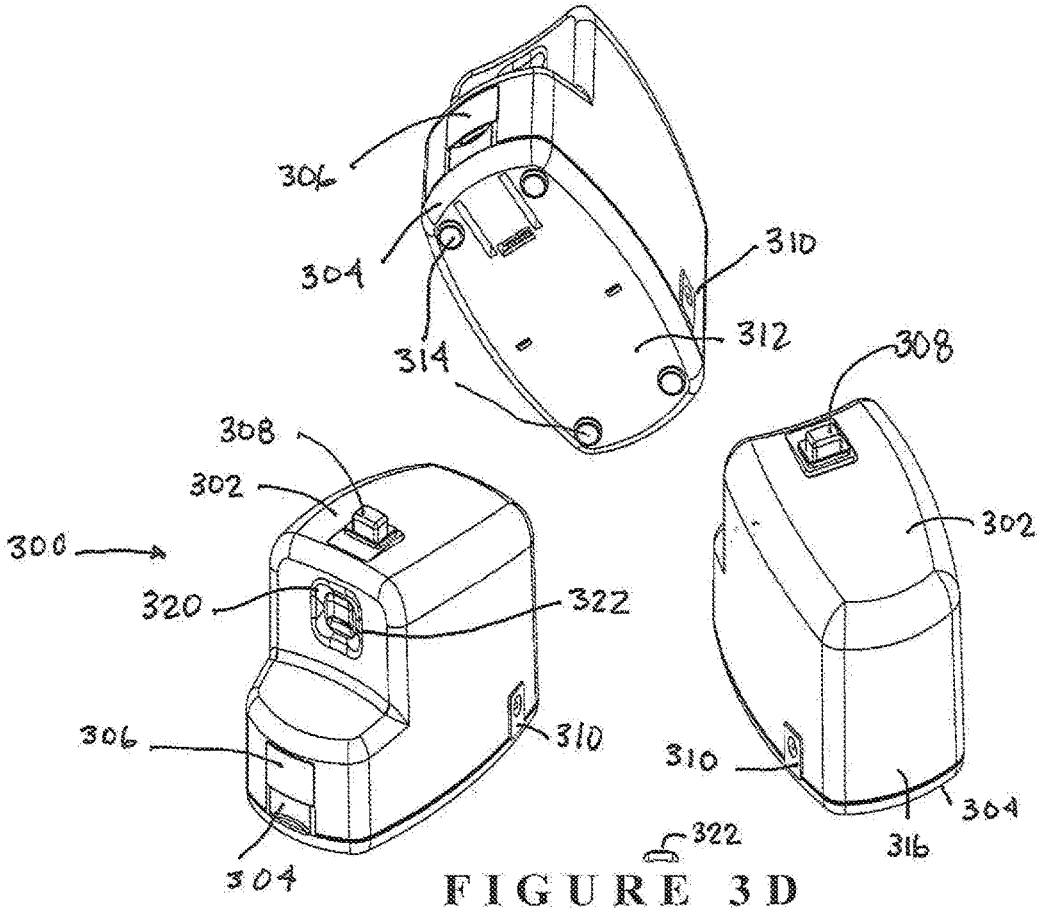
FIG. 3A is a left-side perspective view of an electrically-powered nail cutting apparatus according to the present invention.
FIG. 3B is a top-side perspective view of an electrically-powered nail cutting apparatus according to the present invention.
FIG. 3C is a right-side perspective view of an electrically-powered nail cutting apparatus according to the present invention.
FIG. 3D is a front view of a nail slot showing a flat bottom edge and a curved top edge.

FIG. 3A is a left-side perspective view of an electrically-powered nail cutting apparatus 300 according to the present invention. The electrically-powered nail cutting apparatus 300 is shown with a top 302, bottom 304, removeable nail cuttings tray 306, on-off button 308, external power source connection 310, digit-supporting recessed area 320 and nail-accepting slot 322. Although an external power source is illustrated in this FIG. 3A, an internal battery-source (not shown) may of course be used. Identical numbers in FIGS. 3B and 3C are identical elements in the electrically-powered nail cutting apparatus 300 according to the present invention.

FIG. 3B is a top-side perspective view of an electrically-powered nail cutting apparatus 300 according to the present invention. A bottom plate 312 and legs 314 are shown. The legs 314 may be pads to prevent the electrically-powered nail cutting apparatus 300 according to the present invention from scratching surfaces on which it is placed.

FIG. 3C is a right-side perspective view of an electrically-powered nail cutting apparatus 300 according to the present invention. A back surface 316 is also shown.

FIG. 3D is a front view of a nail-accepting slot 322 showing a flat bottom edge and a curved top edge.

Figure 4:
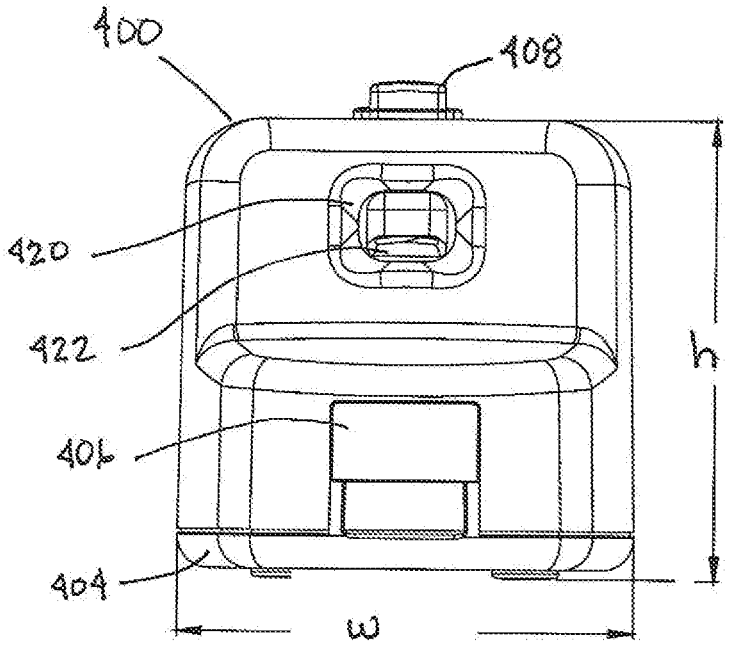
FIG. 4 is a front view of an electrically-powered nail cutting apparatus according to the present invention.

FIG. 4 is a front view of an electrically-powered nail cutting apparatus 400 according to the present invention. The recessed digit receiving area 420 with a nail-accepting slot 422 is shown. The removeable clippings capture tray 406, bottom 404 and on-off button 408 is shown, along with the height h and width w of the device.

Figure 5:
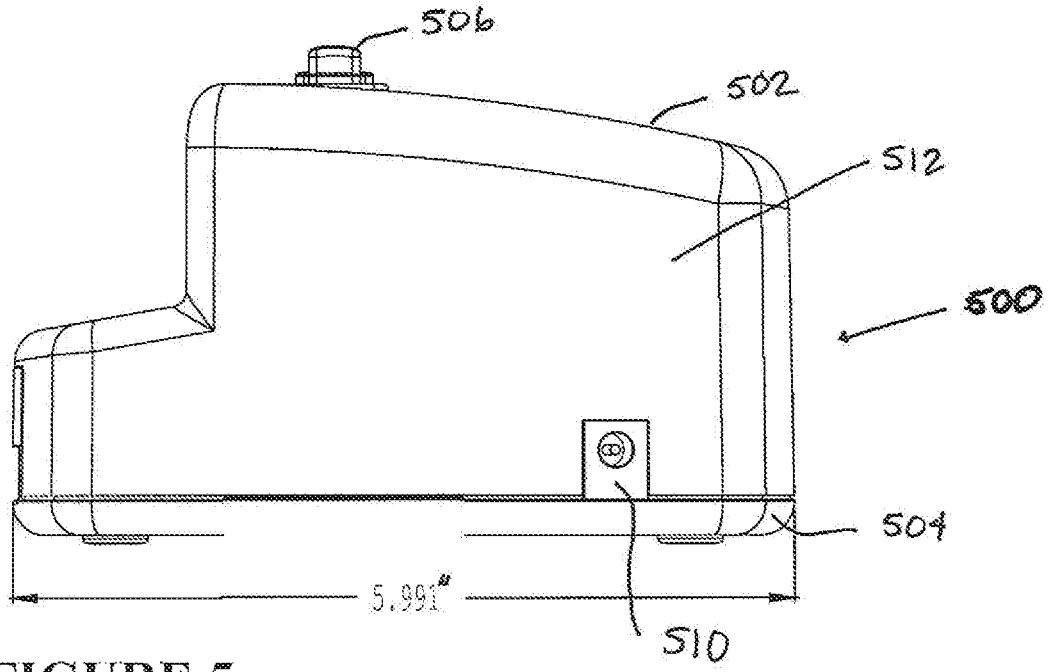
FIG. 5 is a left-side view of an electrically-powered nail cutting apparatus according to the present invention.

FIG. 5 is a left-side view of an electrically-powered nail cutting apparatus 500 according to the present invention. The electrically-powered nail cutting apparatus 500 has a top 502, bottom 504, electric receptor 510, right side wall 512 and on-off button 506.

Figure 6:
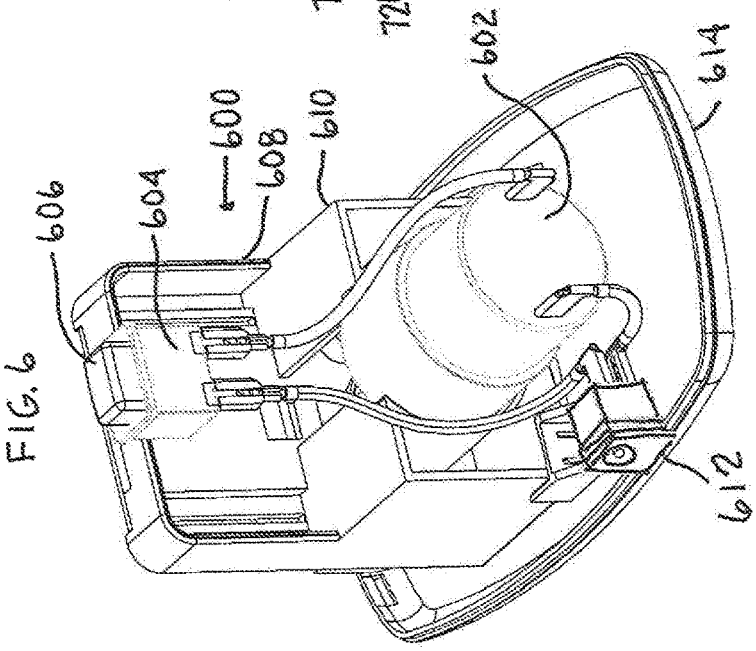
FIG. 6 is a back-to-front perspective view of an opened electrically-powered nail cutting apparatus according to the present invention.

FIG. 6 is a back-to-front perspective view of an opened electrically-powered nail cutting apparatus 600 according to the present invention. Shown on the opened electrically-powered nail cutting apparatus 600 are an electric motor 602, support box 604 for the on-off button 606, and an external structural frame 608 to support forward elements in the opened electrically-powered nail cutting apparatus 600. The external electric source connection 612 is shown overlaying the bottom or base 614.

Figure 7:
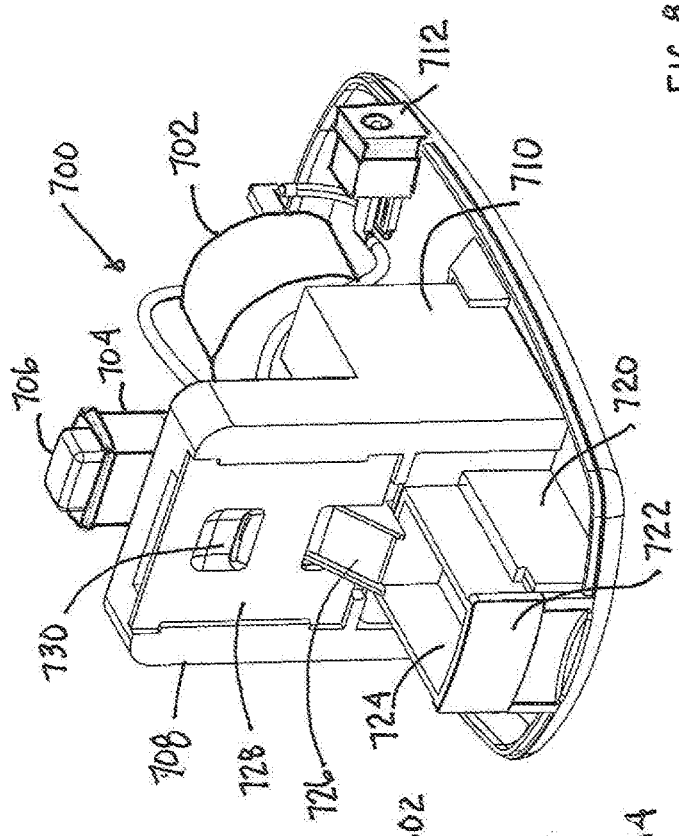
FIG. 7 is a front-to-back perspective view of an opened electrically-powered nail to cutting apparatus according to the present invention.

FIG. 7 is a front-to-back perspective view of an opened electrically-powered nail cutting apparatus 700 according to the present invention. Again are shown an electric motor 702, support box 704 for the on-off button 706, and an external structural frame 708 and 710 to support forward elements in the opened electrically-powered nail cutting apparatus 700. Among the forward elements are the insertable/removable front plate 728, the recessed area for positioning digits 730, a chute 726 for capturing nail clippings (not shown) and directing them for deposit into removable clipping tray 722 with a capture area 724 for the nail clippings. A support frame 720 for guiding the removable tray 722 is shown. The motor may contain a timing function (not shown) such as a circuit, rheostat or microchip to control the speed, time repetition sequence, time intervals and the like for operation of the motor so that the blades moves up and down at an effective rate (e.g., a complete cycle every 5-50 seconds). The circuit may be a field programmable gated array (FPGA) or ASIC (application specific integrated circuit), the first being programmable, and the second being hardened in the integrated circuit.

Figure 8A:
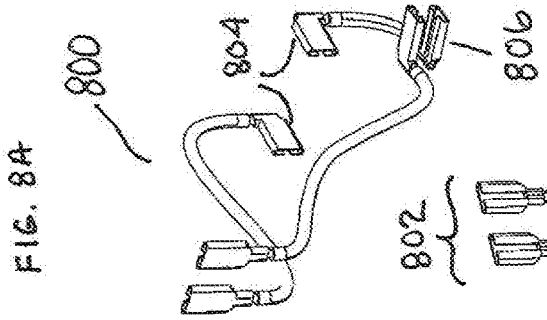
FIG. 8A is a front-to-back perspective view of electrical clips to attach a power source to a motor driving movement of the blade in an electrically-powered nail cutting apparatus according to the present invention.

FIG. 8A is a front-to-back perspective view of electrical clips 800 to attach a power source to a motor driving movement of the blade in an electrically-powered nail cutting apparatus according to the present invention. The two sets of clips, one clipped to the on-off controls 802 and the other connected to the motor 804 are shown. Clip 806 may be a ground or stabilizing clip to prevent excess internal movement of the clips 800. Identical numbers in FIG. 8A are identical elements described in FIG. 8A.

Figure 8B:
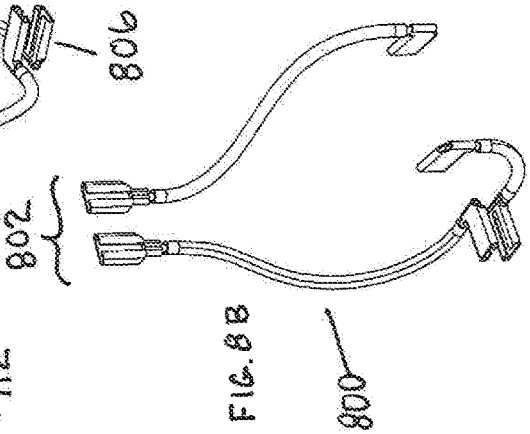
FIG. 8B is a back-to-front perspective view of electrical clips to attach a power source to a motor driving movement of the blade in an electrically-powered nail cutting apparatus according to the present invention.

FIG. 8B is a back-to-front perspective view of electrical clips 800 to attach a power source to a motor driving movement of the blade in an electrically-powered nail cutting apparatus according to the present invention.

Figure 9B:
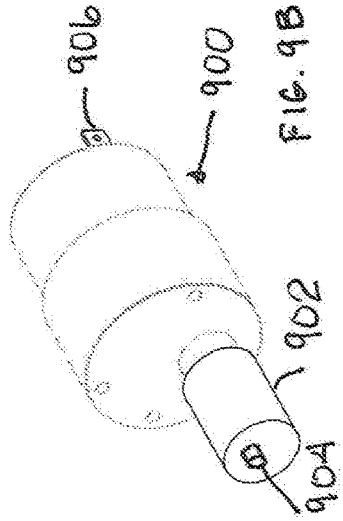
FIG. 9B is a back-to-front perspective view of electrical motor used to assist in motivating cutting blade movement.
Figure 9A:
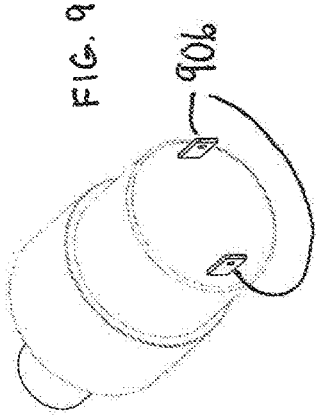
FIG. 9A is a front-to-back perspective view of electrical motor used to assist in motivating cutting blade movement.

FIG. 9A is a front-to-back perspective view of electrical motor 900 used to assist in motivating cutting blade movement. The motor 900 is shown with an electric plug 906, rotating shaft 902 and eccentric cam post 904. As the motor 900 rotates the shaft 902. Looking at the movement of the eccentric cam post 904 and the cam attending opening 204 to assist in movement of the blade unit 200, as shown in FIG. 2, as the cam post 904 is rotated up, the blade unit 200 is elevated to a highest position. As the cam post 904 rotates down, it presses against the lowest interior edge of the cam attending opening 204 to force movement of the blade unit 200 in a downward path. The downward force will press the blade 212 against and through any nail extending into the device. The motor 900 speed and torque applied to the cam post 9042 will determine the frequency of cutting operations and the force applied during those cutting operations. The motor may be programmed to move continuously (same rotation frequency and speed for the shaft 902, or may have its speed in a step manner, such as to move the blade unit 200 down at an optimal speed, stop at a lowest position of the blade unit 200, lift the blade unit at a desired speed (less significant because the speed is merely to reset the blade unit 200 to a pre-cutting position (as with an elevated guillotine blade), and then optionally pause (a light may be used to indicate that a pause position has been reached), and the shaft 902 rotated to force the blade unit 200 down to cut any nail that has been inserted into the device.

FIG. 9B is a back-to-front perspective view of electrical motor 900 used to assist in motivating cutting blade movement. Electrical plugs 906 and the forward positioned shaft 902 are also shown.

Figures 10A, 10B, 10C:
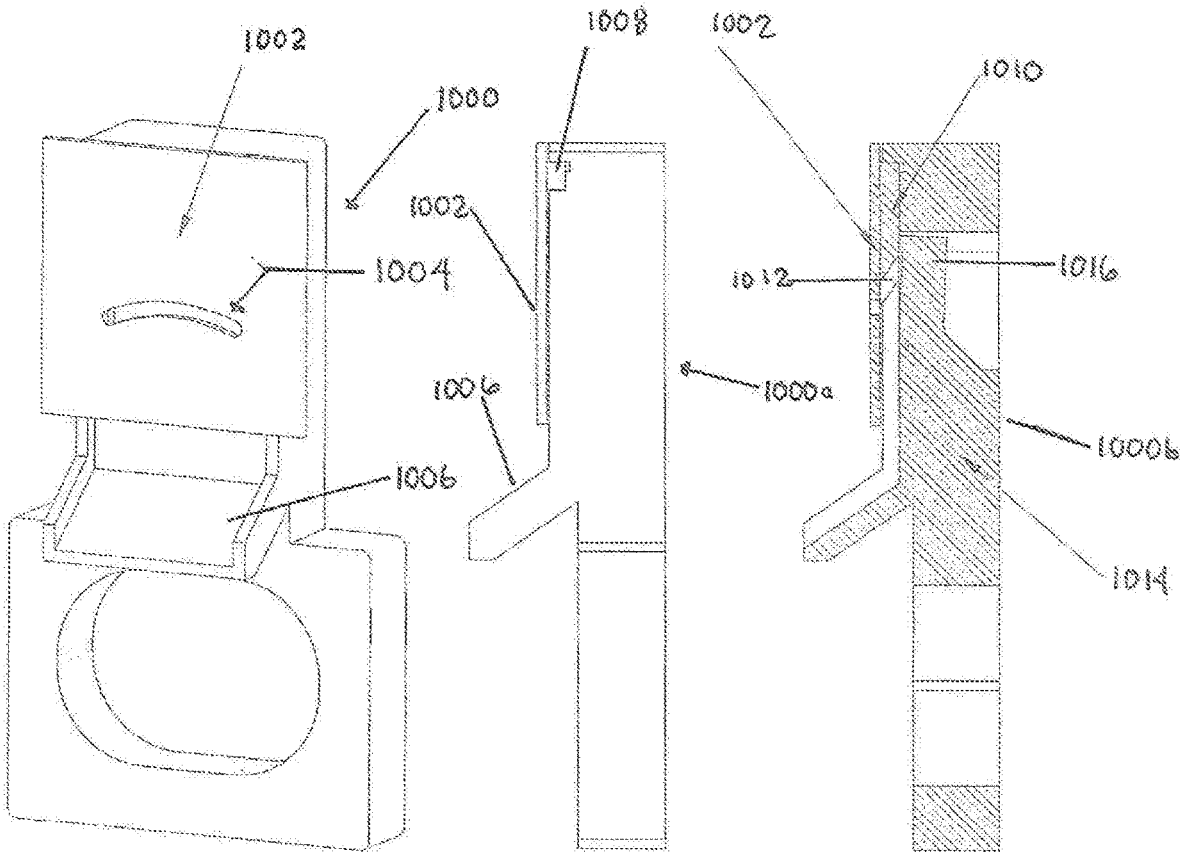
FIG. 10A shows a perspective view of a front section of the electrically-powered nail clipping system of the present invention.
FIG. 10B shows a side cutaway view of the front section of the electrically-powered nail clipping system of the present invention shown in FIG. 10A, but without the blade shown.
FIG. 10C shows a side cutaway view of the front section of the electrically-powered nail clipping system of the present invention shown in FIGS. 10A and 10B, but with the blade shown supported by a spring and glide controls.

FIG. 10A shows a perspective view of a front section of the electrically-powered nail clipping system 1000 of the present invention. The front plate 1002 is shown with the nail accessing curved opening 1004, the chute 1006 for directing nail clippings, FIG. 10B shows a side cutaway view of the front section of the electrically-powered nail clipping system of the present invention 1000*a* shown in FIG. 10A, but without the blade shown. The forward blade support elements 1008 are glide supports on both sides of a blade (not shown). The front plate 1002 and the chute 1006 are also shown.

FIG. 10C shows a side cutaway view of the front section of the electrically-powered nail clipping system of the present invention 1000*b* shown in FIGS. 10A and 10B, but with the blade 1012 shown supported by a spring 1014 and glide controls 1010. The top portion 1016 of the spring 1014 maintain pressure on the blade 1012 so that the blade 1012 remains flush against the inside of the front plate 1002 as the blade 1012 slides up and down.

Figure 11B:
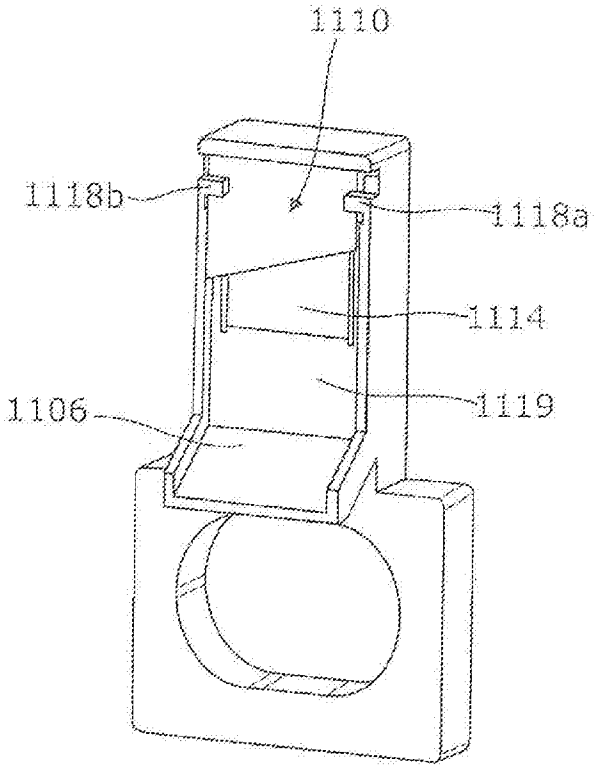
FIG. 11B shows a perspective view of a front section of the electrically-powered nail clipping system of the present invention with the cover plate removed to expose the blade supported by interior supports.
Figure 11A:
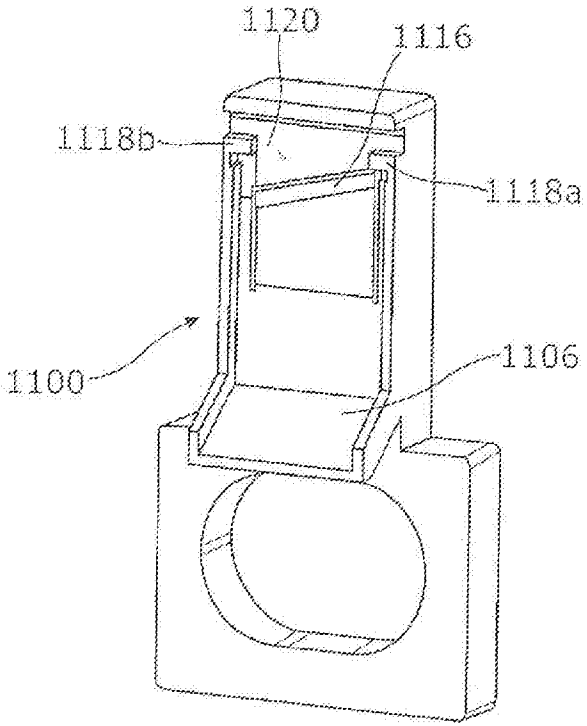
FIG. 11A shows a perspective view of a front section of the electrically-powered nail clipping system of the present invention with the cover plate removed to expose the interior supports for the blade.

FIG. 11A shows a perspective view of a front section of the electrically-powered nail clipping system of the present invention with the cover plate removed to expose the interior supports for the blade.

FIG. 11B shows a perspective view of a front section of the electrically-powered nail clipping system of the present invention with the cover plate FIG. 10C shows a side cutaway view of the front section of the electrically-powered nail clipping system 1000 of the present invention shown in FIG. 10A, but with the blade 1010 shown. The cover 1002 is on the front of the clipping system 1000. The bottom cutting edge 1012 of the blade 1010 is shown supported to between the cover 1002 and a spring/tension-providing plate 1014, with a top, forward pressing component 1016 keeping the blade 1010 as it is driven during a cutting operation.

FIG. 11A shows a perspective view of a front section of the electrically-powered nail clipping system 1100 of the present invention with the cover plate removed to expose the interior supports 1118*a* and 1118*b* for the blade (not present). There is spacing 1120 behind each of the interior supports 1118*a* and 1118*b* and in front of the forward section 1116 of the spring/tension-providing plate 1014 (of FIG. 10B).

FIG. 11B shows a perspective view of a front section of the electrically-powered nail clipping system 1100 of the present invention with the cover plate removed to expose the blade 1110 supported by interior supports of the interior supports or glide controls 1118*a* and 1118*b* on the sides to control a blade (not shown) and in front of the spring/tension-providing plate 1014 above a back plate 1119 above the chute 1106. The combined tension between the interior supports 1118*a* and 1118*b* and in front of the spring/tension-providing plate 1014 established part of a biasing, guiding track for the blade 1110 to travel along and not be deflected out of alignment as cutting edge of the blade slices through a nail.

Although specific materials, dimensions and descriptions are provided, these examples are mere species within the generic concepts of the present invention.

What is claimed:

1. An electrically-powered nail cutting apparatus comprising:

a) a housing having a front face and a rear face, two sides, a top and a bottom;

b) the front face of the housing having an open slot at least 0.5 mm in height and between 0.7 cm and 3 cm in width, the slot having a front-facing opening and a rear-facing opening;

c) within the housing and proximal to the rear-facing opening is a vertically translating nail-cutting blade plate associated with an electric motor that is configured to translate the nail-cutting blade plate consecutively down and up; and d) the nail-cutting blade plate comprising a solid material having an opening therein with a top of the opening and a bottom of the opening, wherein the top of the opening in the solid material comprises a cutting blade with a cutting edge within the opening in the solid material such that the cutting edge is adjacent the rear-facing opening.

2. The apparatus of claim 1 wherein the front-facing opening in the slot further comprises a recess for accepting tips of digits or toes when fingernails or toenails, respectively, are inserted into the slot.

3. The apparatus of claim 1 wherein when the electric motor is configured to continually move the entire blade plate up and down.

4. The apparatus of claim 3 wherein the electric motor engages the blade plate with a rotating cam that engages the blade plate to repetitively move the blade plate up and down.

5. The apparatus of claim 3 wherein the blade plate is supported within a groove located behind the front face of the housing, with the cutting edge proximal to the slot.

6. The apparatus of claim 5 wherein a bracing plate located against a side of the blade plate distal from the cutting edge stabilizes blade plate as the blade plate moves up and down.

7. The apparatus of claim 6 wherein the bracing plate can be inserted or removed from the apparatus by sliding the brace plate within a second groove that secures the blade plate within the apparatus.

8. The apparatus of claim 7 wherein upon removal of the bracing plate from the apparatus, the blade plate becomes exposed and can be removed from the apparatus.

9. The apparatus of claim 8 wherein the bracing plate has raised or extending elements on a surface to transmit pressure against the blade plate.

10. The apparatus of claim 1 wherein when the electric motor is configured to move the entire blade plate up and down, with a time delay in transition from at least one direction to the other.

11. The apparatus of claim 10 wherein the electric motor engages the blade plate with a rotating cam that engages the blade plate to repetitively move the blade plate up and down.

12. The apparatus of claim 10 wherein the blade plate is supported within a groove located behind the front face of the housing, with the cutting edge proximal to the slot.

13. The apparatus of claim 12 wherein a bracing plate located against a side of the blade plate distal from the cutting edge stabilizes blade plate as the blade plate moves up and down.

14. The apparatus of claim 13 wherein the bracing plate can be inserted or removed from the apparatus by sliding the brace plate within a second groove that secures the blade plate within the apparatus.

15. The apparatus of claim 14 wherein upon removal of the bracing plate from the apparatus, the blade plate becomes exposed and can be removed from the apparatus.

16. The apparatus of claim 14 wherein the bracing plate has raised or extending elements on a surface to transmit pressure against the blade plate.

17. A method of cutting human nails on digits selected from the group consisting of fingers and toes comprising:

providing an electrically-powered nail cutting apparatus comprising:

a) a housing having a front face and a rear face, two sides, a top and a bottom;

b) the front face of the housing having an open slot at least 0.5 mm in height and between 0.7 cm and 3 cm in width, the slot having a front-facing opening and a rear-facing opening;

c) within the housing and proximal to the rear-facing opening is a vertically translating nail-cutting blade plate associated with an electric motor that is configured to translate the nail-cutting blade plate consecutively down and up; and d) the blade plate comprising a solid material having an opening therein with a top of the opening and a bottom of the opening, wherein the top of the opening in the solid material comprises a cutting blade with a cutting edge within the opening in the solid material such that the cutting edge is adjacent the rear-facing opening;

the method comprising inserting a human nail into the slot, and the electric motor translating the cutting blade down and across the human nail inserted into the slot, thereby cutting off a portion of the human nail inserted into the slot.

18. The method of claim 17 wherein the front-facing opening in the slot further comprises a recess for accepting tips of digits or toes when fingernails or toenails, respectively, are inserted into the slot, and the recess cushioning the tips of digits while prevent flesh in the digits from entering the slot.

19. The method of claim 17 wherein when the electric motor continually moves the blade plate up and down.

20. The method of claim 17 wherein when the electric motor moves the blade plate up and down, with a time delay in transition from at least one direction of up or down to the other direction.

* * * * *